United States Patent [19]

Ito et al.

[11] Patent Number: 4,610,534

[45] Date of Patent: Sep. 9, 1986

[54] CLEANING DEVICE FOR COPYING MACHINES

[75] Inventors: Fukusaburo Ito, Nara; Hiroshi Kataoka; Keizoh Itoh, both of Yamatokoriyama, all of Japan

[73] Assignee: Sharp Kabushiki Kaisha, Osaka, Japan

[21] Appl. No.: 588,078

[22] Filed: Mar. 9, 1984

[30] Foreign Application Priority Data

Mar. 31, 1983 [JP] Japan ..... 58-47818[U]

[51] Int. Cl.[4] ..... G03G 21/00

[52] U.S. Cl. ..... 355/15; 118/652; 15/256.5

[58] Field of Search ..... 355/15; 15/256.5, 256.51, 15/256.52, 1.5; 118/652

[56] References Cited

U.S. PATENT DOCUMENTS 3,850,521 11/1974 Saupe ..... 355/15

*Primary Examiner*—R. L. Moses

*Attorney, Agent, or Firm*—Birch, Stewart, Kolasch & Birch

[57] ABSTRACT

A cleaning device for an electrophotographic copying machine collects residual toner from the photoconductive surface of a copying machine by using a rotary brush and deposits the collected toner in a specific part such as a filter via vacuum means, wherein it typically includes an air duct formed between a specific part and the rotary brush and a vacuum-activating fan mounted in a proper position inside the air duct.

19 Claims, 2 Drawing Figures

CLEANING DEVICE FOR COPYING MACHINES

BACKGROUND OF THE INVENTION

The present invention relates to an improved cleaning device that collects residual toner from the photoconductive surface of an electrophotographic copying machine by using a rotary brush before the collected toner is eventually deposited in a specific part such as a filter via vacuum means.

Conventionally, there are a variety of methods used for such a cleaning device that collect residual toner from the photoconductive surface. Of these, cleaning by a brush is most widely employed, since it effectively and stably achieves the desired cleaning effect, thus meeting the need for faster copying services.

FIG. 1 shows a typical configuration of a conventional copying machine employing the above-mentioned cleaning device using a brush, in which, corona discharger 2, developer brush 3, transfer corona discharger 4, discharged corona discharger 5, cleaner unit 6, and a discharge lamp 7, are respectively provided around the photoconductive surface 1 at proper intervals. A latent image is formed on the photoconductive surface 1 by charged corona discharger 2 and an exposure light 8 is developed by developer brush 3 before being transferred onto a copying paper by the transfer corona discharger 4. After a transfer operation is completed, residual toner is then removed from the photoconductive surface 1 by the corona discharger 5 and cleaner 6 before being sent to filter 9. Such a cleaner 6 includes a cleaning brush 60 and a scraper that scrapes residual toner from the surface of the brush 60. Filter 9 is provided with a filter bag 90 containing an air filter that collects toner from the cleaner for deposit. A vacuum unit 10 absorbs the removed toner from the cleaner 6 into filter 9 and is provided above the filter 9.

As described above, such a conventional cleaning device includes the said cleaner 6 that wipes the residual toner from the photoconductive surface 1, filter 9 collecting the removed toner, and a vacuum unit 10 behind the vacuum passage used for collecting the removed toner. However, since these devices are located behind the vacuum passage, i.e., behind the filter unit, quite a powerful vacuum force is needed to effectively collect the removed toner, and thus, relatively great vacuum capacity should be provided. In addition, due to the increased vacuum capacity, an AC motor should also be provided, thus unavoidably requiring a larger space, while generating unwanted noise and causing relatively large amounts power to be dissipated.

OBJECTS AND SUMMARY OF THE INVENTION

It is an object of the present invention to provide a cleaning device that effectively minimizes noise and power consumption and also achieves a compact configuration of the entire unit by providing a vacuum unit in front of a specific part of the unit that collects the residual toner.

A preferred embodiment of the present invention provides a cleaning device that collects the residual toner from the photoconductive surface of a copying machine by using a rotary brush and then deposits the collected toner in a specific part, via vacuum means, in which it provides an air duct between the specific part and rotary brush, and in addition, it provides a vacuum fan in a proper position inside the air duct. As described above, a preferred embodiment of the present invention provides an air duct between a specific toner deposit part such as a filter bag and a rotary brush, while the vacuum fan provided in a proper position inside the air duct minimizes loss of the absorbing vacuum force, and as a result, an extremely compact fan motor can be used, while noise and power consumption are minimized. In addition, such a configuration makes it possible to construct a copying machine at a low cost with simple construction without containing a filter bag cover that is otherwise needed for any of the conventional devices.

DETAILED DESCRIPTION OF THE INVENTION

Figure 1:
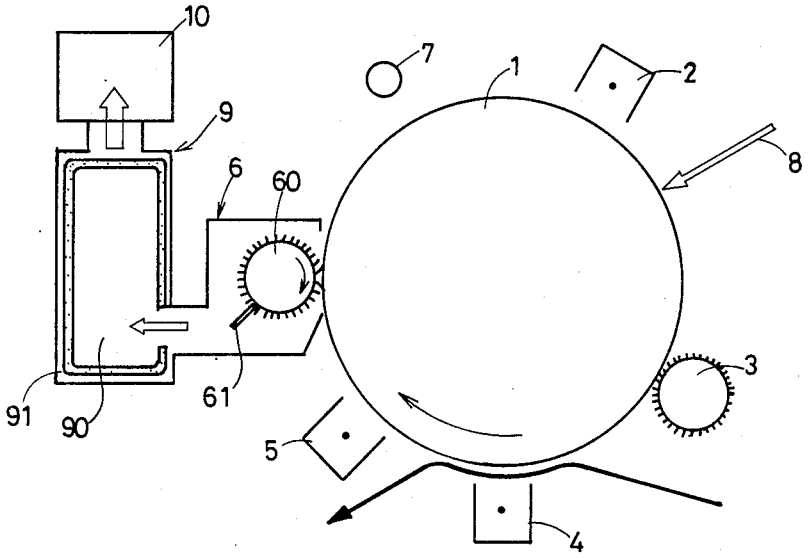
Background Art FIG.1
FIG. 1 is a simplified block diagram of a conventional copying machine containing a conventional cleaning device.
Figure 2:
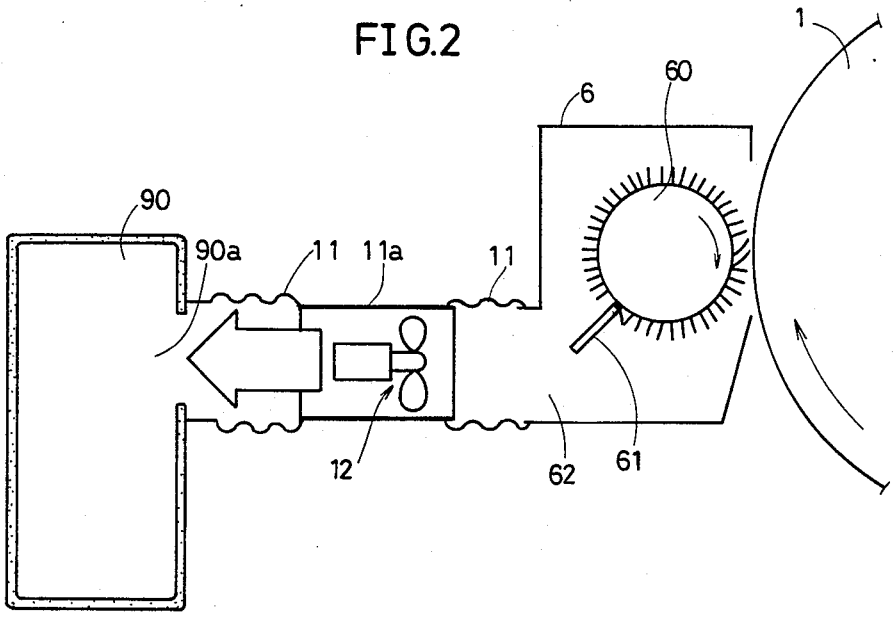
FIG. 2 is a simplified block diagram of a cleaning device as a preferred embodiment of the present invention.

FIG. 2 is a simplified block diagram of a cleaning device as a preferred embodiment of the present invention. The cleaning device of FIG. 2 includes a configuration that is entirely different from any of the conventional cleaning devices typically shown in FIG. 1. The cleaning device in the preferred embodiment of the present invention typically incorporates an air duct 11 connected between an opening 62 behind the cleaner and the other opening **90*a* of filter bag 90 that deposits the removed toner, and a vacuum-activating propeller fan 12 in the center part of the air duct. The center part of air duct 11 is composed of sleeves 11*a* to which said propeller fan 12** is secured.

Residual toner removed from the photoconductive surface 1 by both the rotary brush 60 and scraper 61 is first attracted by a vacuum developed by propeller fan 12 before being sent to the filter bag 90 via an air duct 11 and the propeller fan 12. Since the filter bag 90 is composed of an air filter as with the one shown in FIG. 1, only the collected toner is deposited inside the air filter, while air is exhausted outside. In order to prevent the bearing part of said fan motor from being clogged by the vacuumed toner containing several ten microns of fine particles, the bearing part of the fan motor should desirably be sealed. Likewise, in order to prevent portions adjacent to the motor from being heated, for example the image transfer glass, air duct 11 including sleeve **11*a* should be desirably be composed of such a material having satisfactory heat radiation effects. Since the vacuum activating propeller fan 12 is provided in a proper position inside the air duct, the cleaning device embodied by the present invention makes it possible to set both the propeller fan 12 and cleaner 6 at a distance close to each other as compared to that shown in FIG. 1, and as a result, the propeller fan 12 can apply its vacuum force directly to the cleaner 6, thus minimizing loss. In addition, since the air to be externally discharged from the filter bag 90 may be released to any areas where no problems arise, such a filter bag cover (reference 91 shown in FIG. 1**) which is otherwise needed for any of the conventional units can be eliminated.

What is claimed is:

1. A cleaning device for cleaning residual toner from a photosensitive surface of an electrophotographic copying maching comprising:

means for removing the residual toner from the photoconductive surface;

receptacle means for collecting said residual toner;

an air duct interconnecting said means for removing to said receptacle means, said air duct transferring the residual toner from said means for removing to said receptacle means of an airstream; and a vacuum fan disposed within said air duct between said means for removing and said receptacle means and creating the airstream.

2. The device of claim 1 wherein said receptacle means is a filter primarily receiving the residual toner.

3. The device of claim 2 wherein said means for removing comprises a rotary brush contacting the photoconductive surface.

4. The device of claim 3 wherein said means for removing further comprises a scraper removing the residual toner from said rotary brush.

5. The device of claim 4 wherein said scraper deposits the residual toner into said airstream;

said filter removing the residual toner from the airstream.

6. The device of claim 1 wherein said receptacle means collects substantially all toner removed from the photoconductive surface by said means for removing.

7. The device of claim 6 wherein said receptacle means is a filter primarily receiving the residual toner.

8. A cleaning device for cleaning residual toner from a photoconductive surface of an electrophotographic copying means comprising:

means for removing the residual toner from the photoconductive surface;

receptacle means for collecting said residual toner;

means, coupled between said means for removing and said receptacle means, for transferring the residual toner from said means for removing to said receptacle means, said means for transferring including, an air duct interconnecting said means for removing to said receptacle means, a fan disposed in said air duct and developing an airstream from said means for removing to said receptacle means;

said means for removing placing the residual toner into said airstream, said receptacle means collecting the residual toner from said airstream.

9. The device of claim 8 wherein said means for removing comprises a rotary brush contacting the photoconductive surface.

10. The device of claim 9 wherein said means for removing further comprises a scraper removing the residual toner from said rotary brush.

11. The device of claim 8 wherein said receptacle means collects substantially all toner removed from the photoconductive surface by said means for removing.

12. The device of claim 11 wherein said receptacle means is a filter primarily receiving the residual toner.

13. A cleaning device for cleaning residual toner from a photoconductive surface of an electrophotographic copying machine comprising:

a rotary brush contacting the photoconductive surface and removing the residual toner therefrom;

scraper means operatively connected to said rotary brush for removing the residual toner from said brush;

an air duct;

receptacle means, separated from said rotary brush by said air duct, for collecting the residual toner from said rotary brush;

airstream generation means for developing an airstream supporting residual toner in said air duct to transfer the residual toner from said rotary brush to said receptacle means, said airstream generation means supplying said airstream supporting residual toner to said receptacle means under a positive pressure;

said receptacle means separating the residual toner from said airstream.

14. The device of claim 13 wherein said receptacle means is a filter primarily receiving the residual toner.

15. The device of claim 14 wherein said filter is not surrounded by a housing.

16. The device of claim 13 wherein said scraper means deposits the residual toner removed from said brush into said airstream.

17. The device of claim 13 wherein said receptacle means collects substantially all toner removed from the photoconductive surface by said means for removing.

18. The device of claim 13 wherein said airstream generation means comprises an electric blower.

19. The device of claim 18 wherein said electric blower includes a propeller type fan.

* * * * *